US012735781B2

(12) United States Patent
Cho et al.

(10) Patent No.: US 12,735,781 B2
(45) Date of Patent: Sep. 15, 2026

(54) COMPOSITION FOR TREATING SURFACE OF TERNARY HOT-DIP GALVANIZED STEEL SHEET HAVING EXCELIENT CORROSION RESISTANCE AND ENVIRONMENTAL STABILITY, TERNARY HOT-DIP GALVANIZED STEEL SHEET THAT IS SURFACE-TREATED USING SAME, AND METHOD FOR MANUFACTURING SAME

(71) Applicants: POSCO CO., LTD, Pohang-si (KR); NOROO COIL COATINGS CO., LTD., Pohang-Si (KR)

(72) Inventors: Soo-Hyoun Cho, Gwangyang-si (KR); Dong-Yun Kim, Anyang-si (KR); Chang-Hoon Choi, Gwangyang-si (KR)

(73) Assignees: POSCO CO., LTD, Pohang-si (KR); NOROO COIL COATINGS CO., LTD., Pohang-si (KR)

( * ) Notice: Subject to any disclaimer, the term of this patent is extended or adjusted under 35 U.S.C. 154(b) by 161 days.

(21) Appl. No.: 18/714,457

(22) PCT Filed: Nov. 21, 2022

(86) PCT No.: PCT/KR2022/018406
§ 371 (c)(1),
(2) Date: May 29, 2024

(87) PCT Pub. No.: WO2023/101291
PCT Pub. Date: Jun. 8, 2023

(65) Prior Publication Data

US 2026/0168073 A1 Jun. 18, 2026

(30) Foreign Application Priority Data

Nov. 30, 2021 (KR) ..... 10-2021-0168850

(51) Int. Cl.
*C23C 28/02* (2006.01)
*C23C 2/12* (2006.01)
*C23C 2/28* (2006.01)

(52) U.S. Cl.
CPC ..... *C23C 2/12* (2013.01); *C23C 2/28* (2013.01); *C23C 28/021* (2013.01)

(58) Field of Classification Search
None
See application file for complete search history.

(56) References Cited

U.S. PATENT DOCUMENTS

| | | | |
|---|---|---|---|
| 5,399,209 A | 3/1995 | Suda et al. | |
| 6,071,435 A | 6/2000 | Komiyama et al. | |
| 6,465,114 B1 | 10/2002 | Honda et al. | |
| 2007/0023104 A1 | 2/2007 | Yamamoto et al. | |
| 2007/0086938 A1 | 4/2007 | Kotaki et al. | |
| 2010/0180793 A1 | 7/2010 | Dingwerth et al. | |
| 2010/0247956 A1 | 9/2010 | Katoh et al. | |
| 2012/0091398 A1* | 4/2012 | Hofmann | C23C 22/83 106/14.12 |
| 2019/0264334 A1 | 8/2019 | Cho et al. | |
| 2020/0291527 A1 | 9/2020 | Cho et al. | |
| 2021/0388504 A1 | 12/2021 | Cho et al. | |
| 2022/0371049 A1 | 11/2022 | Cho et al. | |

FOREIGN PATENT DOCUMENTS

| | | | |
|---|---|---|---|
| CN | 1105713 | A | 7/1995 |
| CN | 102936742 | A | 2/2013 |
| CN | 112481574 | A | 3/2021 |
| JP | H04-9477 | A | 1/1992 |
| JP | 2001-323385 | A | 11/2001 |
| JP | 2002-069660 | A | 3/2002 |
| JP | 2003-313675 | A | 11/2003 |
| JP | 2007-321234 | A | 12/2007 |
| JP | 2010-529300 | A | 8/2010 |
| JP | 2012-141619 | A | 7/2012 |
| JP | 2023-512888 | A | 3/2023 |
| KR | 10-2002-0019446 | A | 3/2002 |
| KR | 10-2004-0046347 | A | 6/2004 |
| KR | 10-2005-0052215 | A | 6/2005 |
| KR | 10-2006-0121152 | A | 11/2006 |
| KR | 10-2006-0123628 | A | 12/2006 |
| KR | 10-0787737 | B1 | 12/2007 |
| KR | 10-2008-0087477 | A | 10/2008 |
| KR | 10-2010-0106031 | A | 10/2010 |
| KR | 10-2015-0075001 | A | 7/2015 |
| KR | 10-1786392 | B1 | 10/2017 |
| KR | 10-2018-0135514 | A | 12/2018 |
| KR | 10-2019-0054283 | A | 5/2019 |
| KR | 10-2020-0046514 | A | 5/2020 |
| KR | 10-2021-0035955 | A | 4/2021 |
| KR | 10-2021-0077527 | A | 6/2021 |

OTHER PUBLICATIONS

International Search Report and Written Opinion dated Feb. 21, 2023 issued in International Patent Application No. PCT/KR2022/018406 (with English translation).
Japanese Decision to Grant dated Jan. 6, 2026 issued in Japanese Patent Application No. 2024-531647.
Chinese Office Action dated Jul. 14, 2026 issued in Chinese Patent Application No. 202280079168.9 (with English translation).

* cited by examiner

*Primary Examiner* — Kim S. Horger
(74) *Attorney, Agent, or Firm* — Morgan Lewis & Bockius LLP

(57) ABSTRACT

The present invention relates to a composition for surface treatment to improve the corrosion resistance, environmental stability, and the like of a metal material, in particular, a hot-dip galvanized steel sheet used for construction materials, a ternary hot-dip galvanized steel sheet that is surface-treated using the composition, and a method for manufacturing the same.

20 Claims, No Drawings

COMPOSITION FOR TREATING SURFACE OF TERNARY HOT-DIP GALVANIZED STEEL SHEET HAVING EXCELIENT CORROSION RESISTANCE AND ENVIRONMENTAL STABILITY, TERNARY HOT-DIP GALVANIZED STEEL SHEET THAT IS SURFACE-TREATED USING SAME, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2022/018406, filed on Nov. 21, 2022, which in turn claims the benefit of Korean Application No. 10-2021-0168850, filed on Nov. 30, 2021, the disclosures of which applications are incorporated by reference herein.

TECHNICAL FIELD

The present disclosure relates to a composition for surface treatment to improve corrosion resistance and environmental stability of metal materials, especially a hot-dip galvanized alloy-plated steel sheet used for construction materials, a ternary hot-dip galvanized steel sheet surface-treated using the composition, and a method for manufacturing the same.

BACKGROUND ART

In general, compared with a pure galvanized steel sheet, as a steel material with excellent red rust corrosion resistance, a steel sheet with a zinc alloy layer containing magnesium (Mg), aluminum (Al), etc., has most of the exposed surface formed of zinc (Zn) or zinc alloy (Zn alloy), so when the steel sheet is exposed to a general environment, especially a humid atmosphere, white rust occurs on the surface of the steel sheet. In addition, since Mg and Al contained in a plating layer have a better affinity for oxygen than Zn, oxygen binding to zinc becomes insufficient, so blackening phenomenon is prone to occur.

To solve this problem, conventionally, as part of rust prevention treatment, a plated steel sheet is treated with chromate containing hexavalent chromium, or a metal surface is pre-treated with 5 to 100 mg/m$^2$ of chromate to form an organic film. However, when the surface treatment is applied to a ternary galvanized steel sheet, there is still a problem of defects such as changing to black or generating black spots.

Accordingly, a corrosion-resistant metal coating agent that does not contain hexavalent chromium was recently developed, and a method for securing corrosion resistance and anti-blackening properties of a plated steel sheet was applied.

For example, in Patent Documents 1 to 3, an attempt was made to secure corrosion resistance and blackening by immersing steel sheet in a composition containing trivalent chromium and chemically treating the steel sheet. However, there is a problem in that the process applied to a continuous process of steel companies has a long immersion time, and the chemical treatment method reduces fingerprint resistance, etc.

In addition, Patent Documents 4 and 5 disclose a method that can be applied to a continuous line of steel mills using a spray or roll coater method and secure an anti-fingerprints property. However, it is not suitable for Mg and Al alloy steel sheet which are prone to severe discoloration in a humid atmosphere due to the use of porous silica components. In addition, the porous silica has strong moisture absorption properties, so there is a problem of causing rapid discoloration in Mg, Al, and Zn alloy steel sheet.

In addition, in order to be used as a steel material for construction materials, there is an increasing need to provide environmental stability so that the steel material may be used even in outdoor high-temperature and high-humidity environments and wet environments when used by customers.

(Patent Document 1) Korean Patent Laid-Open Publication No. 10-2006-0123628

(Patent Document 2) Korean Patent Laid-Open Publication No. 10-2005-0052215

(Patent Document 3) Korean Patent Laid-Open Publication No. 10-2009-0024450

(Patent Document 4) Korean Patent Laid-Open Publication No. 10-2004-0046347

(Patent Document 5) Japanese Patent Laid-Open Publication No. 2002-069660

DISCLOSURE

Technical Problem

The present disclosure provides a composition for surface treatment of a ternary hot-dip galvanized steel sheet capable of providing excellent corrosion resistance, anti-blackening properties, environmental stability, etc., in order to provide a hot-dip galvanized alloy-plated steel sheet for construction materials, a ternary hot-dip galvanized steel sheet surface-treated using the composition, and a method for manufacturing the same.

The subject of the present disclosure is not limited to the above. The subject of the present disclosure will be understood from the entire contents of this specification, and those of ordinary skill in the art to which the present disclosure pertains will have no difficulty in understanding the additional tasks of the present disclosure.

Technical Solution

In an aspect in the present disclosure, there is provided a composition for surface-treating a ternary hot-dip galvanized steel sheet, including: with respect to 100 wt % of solid part of a composition, (a) 15 to 45 wt % of chromium compound; (b) 45 to 75 wt % of rust prevention coating agent; (c) 0.1 to 3.0 wt % of rust prevention etchant; (d) 0.1 to 5.0 wt % of corrosion resistance additive; (e) 0.1 to 3.0 wt % of lubricant; and (f) 0.1 to 1.0 wt % of defoamer, in which the chromium compound may be obtained by adding (g) 0.5 to 5.0 wt % of phosphorous acid as a reducing agent and (h) 0.1 to 2.0 wt % of phosphoric acid as a catalyst in a solution of chromium nitrate A and chromate B.

In another aspect in the present disclosure, there is provided a surface-treated ternary hot-dip galvanized steel sheet, including a steel sheet; a Zn—Mg—Al-based plating layer formed on at least one surface of the steel sheet; and a surface-treated coating layer formed on the plating layer, in which the surface-treated coating layer may be a coating layer formed of the composition for surface treatment.

In another aspect in the present disclosure, there is provided, a method for manufacturing a surface-treated ternary hot-dip galvanized steel sheet, including: forming a Zn—Mg—Al-based plating layer by hot-dip galvanizing at least one surface of the steel sheet; performing coating treatment on the composition for surface treatment on the plating layer; and performing drying treatment on the coated steel sheet.

Advantageous Effects

According to the present disclosure, it is possible to provide a composition for surface treatment with excellent solution stability, and a ternary hot-dip galvanized steel sheet surface-treated using this composition has excellent corrosion resistance, anti-blackening properties, and alkali resistance.

BEST MODE

The inventors of the present disclosure have conducted in-depth research to obtain a solution composition that may impart properties such as corrosion resistance, anti-blackening properties, environmental stability, and alkali resistance to a hot-dip galvanized alloy-plated steel sheet for construction materials, for example, a ternary (Zn—Mg—Al-based) hot-dip galvanized steel sheet.

As a result, it is possible to provide a composition in which a rust prevention coating agent, a rust prevention etchant, a corrosion resistance additive, a lubricant, and a deformer are mixed in an appropriate amount in addition to a chromium compound. After confirming that the solution stability of the composition is high and that the intended effects may be obtained when a ternary hot-dip galvanized steel sheet is surface-treated using the composition, the present disclosure has been completed.

Hereinafter, the present disclosure will be described in detail.

First, the composition for surface-treating a ternary hot-dip galvanized steel sheet according to an aspect of the present disclosure will be described in detail.

According to an aspect of the present disclosure, a composition for surface-treating a ternary hot-dip galvanized steel sheet may include: with respect to 100 wt % of solid part of a composition, (a) 15 to 45 wt % of chromium compound, (b) 45 to 75 wt % of rust prevention coating agent, (c) 0.1 to 3.0 wt % of rust prevention etchant, (d) 0.1 to 5.0 wt % of corrosion resistance additive; (e) 0.1 to 3.0 wt % of lubricant; and (f) 0.1 to 1.0 wt % of defoamer.

The composition of the present disclosure further includes (g) a reducing agent and (h) a catalyst to obtain the chromium compound, and the total weight of the composition includes the contents of the reducing agent and the catalyst.

The composition of the present disclosure has a solid part content of 5 to 20 wt % with respect to the total weight of the composition.

As will be described in detail later, the composition may form a coating layer on at least one surface of a substrate on which the composition may be applied. In the present disclosure, the substrate may be the above-described steel sheet, such as the ternary hot-dip galvanized steel sheet, and specifically may be a Zn—Mg—Al-based alloy-plated steel sheet.

In the following, each component constituting the composition will be described in detail.

(a) 15 to 45 wt % of Chromium Compound

In the composition of the present disclosure, a chromium compound is an essential component and serves to secure corrosion resistance and anti-blackening properties, etc.

The chromium compound is produced by dissolving chromium nitrate A and chromate B in a solvent (water), and therefore, includes the chromium nitrate A and the chromate B. In this case, a content ratio A/A+B of the chromium nitrate and chromate may be 0.3 to 0.6. When a content ratio is less than 0.3, the corrosion resistance and anti-blackening properties to be achieved may be lowered, whereas when the content ratio exceeds 0.6, solution stability may be lowered.

More specifically, the chromium compound is produced by adding 0.5 to 5.0 wt % of phosphorous acid, which is the (g) reducing agent, to a chromium solution in which chromium nitrate A and chromate B are dissolved, thereby reducing hexavalent chromium ions formed by dissolving chromate to trivalent chromium ions. In this case, 0.1 to 2.0 wt % of phosphoric acid as (h) the catalyst may be added so that the reduction reaction may occur smoothly.

From this, a chromium compound with a reduction ratio (trivalent chromium ion/(trivalent chromium ion+hexavalent chromium ion)) of 0.75 to 0.90 may be obtained. When the reduction ratio is less than 0.75, the content of the trivalent chromium ion is insufficient, so there is a risk that the corrosion resistance may not be secured due to a shielding effect and the anti-blackening properties are insufficient. On the other hand, when the reduction ratio exceeds 0.90, the hexavalent chromium ions are insufficient, so there may be a problem in that a self-repairing effect is reduced and the corrosion resistance of the processed area is reduced.

When the content of the phosphorous acid is less than 0.5 wt %, there is a problem in that the reduction ratio of the chromium compound is lowered to 0.75 or less, whereas when the content exceeds 5.0 wt %, there is a problem in that the reduction ratio exceeds 0.9.

The phosphoric acid used as the catalyst supplies free acid to serve to promote the smooth reduction of hexavalent chromium ions generated by dissolving the chromate into trivalent chromium ions by the phosphorous acid. When the content of the phosphoric acid is less than 0.1 wt %, the catalytic action becomes insufficient, whereas when the content exceeds 2.0 wt %, there is a risk that the corrosion resistance may be impaired due to the excessive presence of free acid.

Here, it should be noted that the contents of the reducing agent and catalyst are for 100 wt % of solid part of the composition of the present disclosure.

With respect to 100 wt % of solid part of the composition of the present disclosure, when the content of the chromium compound is less than 15 wt %, a strong insoluble film layer becomes thin, so moisture penetration is not effectively blocked on the surface of the plated steel sheet where the corrosion resistance is required. As a result, there is a problem of causing the blackening and reducing the corrosion resistance. On the other hand, when the content exceeds 45 wt %, the contents of other components are added to improve the corrosion resistance, and specifically, the contents of the rust prevention coating agent, the rust prevention etchant, the corrosion resistance additive, the lubricant, the deformer, etc., are reduced, so there is a problem in that it is difficult to secure the sufficient corrosion resistance, the anti-blackening properties, the environmental stability, etc.

(b) 45 to 75 wt % of Rust Prevention Coating Agent

In the composition of the present disclosure, the rust prevention coating agent is a main ingredient along with the chromium compound, and plays a role in securing basic corrosion resistance, anti-blackening properties, etc. In particular, in the case of surface-treating the plated steel sheet (ternary hot-dip galvanized steel sheet), it severs to maintain environmental stability, in particular, excellent environmental stability by preventing film peeling due to moisture absorption of the chromium compound film, especially under the high-temperature, high-humidity environment.

As the rust prevention coating agent, an organosilane sol-gel binder may be used.

Specifically, the organosilane sol-gel binder may include two or three or more types of silicone compounds selected from the group consisting of 2-(3,4 epoxycyclohexyl)-ethyltrimethoxysilane, 3-glycyloxypropyl trimethoxysilane, 3-glycyloxypropyl methyldiethoxysilane, 3-glycyloxypropyl triethoxysilane, N-2-(aminoethyl)-3-aminopropyl methyldimethoxysilane, N-2-(aminoethyl)-3-aminopropyl trimethoxysilane, N-2-(aminoethyl)-3-aminopropyl triethoxysilane, 3-aminopropyl trimethoxy silane, 3-aminopropyl triethoxy silane, 3-ureido propyltrimethoxy silane, and 3-ureido propyltrialkoxy silane.

When the content of the rust prevention coating agent is less than 45 wt % with respect to 100 wt % of solid part of the composition of the present disclosure, a solid film layer may not be formed, making it difficult to secure the corrosion resistance and environmental stability. On the other hand, when the content exceeds 75 wt %, there is a problem in that the anti-blackening properties decreases due to the decrease in the content of the chromium compound.

(c) 0.1 to 3.0 wt % of Rust Prevention Etchant

In the composition of the present disclosure, the rust prevention etchant serves to increase the rust prevention effect by etching the surface and forming the solid bond with the surface-treated composition when surface-treating the plated steel sheet.

The rust prevention etchant may be one or more of titanium hydrofluoric acid, silicified hydrofluoric acid, and zirconium hydrofluoric acid.

With respect to 100 wt % of solid part of the composition of the present disclosure, when the content of the rust prevention etchant is less than 0.1 wt %, the etching action is not sufficient, so there is a risk that the bond between the surface-treated composition and the plated steel sheet is insufficient, leading to the decrease in the corrosion resistance. On the other hand, when the content exceeds 3.0 wt %, there is a problem of deterioration of the anti-blackening properties due to the excessive etching action.

(d) 0.1 to 5.0 wt % of Corrosion Resistance Additive

In the composition of the present disclosure, the corrosion resistance additive serves to fill crack areas that occur during the processing of the surface-treated plated steel sheet, and therefore, is advantageous in improving corrosion resistance of the processed area.

The corrosion resistance additive may be one or more selected from the group consisting of lithium silica sol, sodium silicate, potassium silicate, lithium-potassium silicate, and lithium-sodium silicate.

With respect to 100 wt % of solid part of the composition of the present disclosure, when the content of the corrosion resistance additive is less than 0.1 wt %, the occurrence of cracks increases during the processing of the surface-treating plated steel sheet, and the corrosion resistance of the processed area decreases, whereas when the content exceeds 5.0 wt %, there is a problem in that the solution stability is inferior.

(e) 0.1 to 3.0 wt % of Lubricant

In the composition of the present disclosure, the lubricant serves to suppress the generation of foreign objects by adhering the film of the surface treatment composition to the coating material (e.g., roll, etc.) since the organosilane sol-gel binder, which is the rust prevention coating agent, is sticky under high-temperature and high-humidity environments.

The lubricant may be a wax component dispersed with a non-ionic dispersant so that it may be used in the acidic composition of the present disclosure. Specifically, the lubricant may be one or more selected from the group consisting of polyethylene wax, polypropylene wax, carnauba wax, paraffin wax, polyamide wax, PTFE wax, eco-friendly oil wax, EAA wax, and synthetic EVA wax.

With respect to 100 wt % of solid part of the composition of the present disclosure, when the content of the lubricant is less than 0.1 wt %, there is a problem in that foreign object defects excessively occur in high-temperature and high-humidity environments, whereas the content of the lubricant exceeds 3.0 wt %, there is a problem in that the shielding effect decreases and the corrosion resistance is inferior.

(f) 0.1 to 1.0 wt % of Defoamer

In the composition of the present disclosure, the defoamer serves to suppress deterioration in coatability due to foam generation during the process of stirring the composition into the solution state to surface-treat the plated steel sheet.

As the defoamer, a silicone-based defoamer may be used, and as a non-limiting example, polydimethylsiloxane may be used.

With respect to 100 wt % of solid part of the composition of the present disclosure, when the content of the defoamer is less than 0.1 wt %, the defoaming effect is not sufficient, so there is a problem in that coating workability decreases due to the generation of bubbles on the solution surface. On the other hand, when the content exceeds 1.0 wt %, there is a problem in that the solution stability decreases and the surface defects occur during customer painting.

(i) Solvent

The composition of the present disclosure including all of the above-described components has the content of the solid part of 5 to 20 wt % and may include a solvent as the balance. In the present disclosure, water may be used as the solvent, and the components added to the composition may be diluted using the water. Here, the water means deionized water or distilled water.

The content of the solvent may be 80 to 95 wt %. When the content of the solvent is less than 80 wt %, there is a risk that spreadability may not be sufficient when coating the composition of the present disclosure on the plated steel sheet in a liquid state. On the other hand, when the content exceeds 95%, there is a risk that the adhesion amount of the dried composition after coating the composition may not be secured.

In the present disclosure, as the solvent, an auxiliary solvent may be further included in addition to water, and the auxiliary solvent include one or more selected from the group consisting of ethyl alcohol, methyl alcohol (methanol), isopropyl alcohol, 1-methoxy-2-propanol, and 2-butoxyethanol.

The auxiliary solvent may be contained in an amount of 20 to 40 wt % based on the total content of solvent. When the content of the auxiliary solvent is less than 20% of the total solvent content, there is a risk that the components constituting the solution composition may not be stably dispersed in the solvent, whereas when the content exceeds 40%, there is a problem in that the corrosion resistance decreases and the work environment deteriorates due to the smell of the solution.

Hereinafter, the surface-treated steel sheet having a certain coating layer by surface-treating the above-described composition according to another aspect of the present disclosure, specifically the surface-treated ternary hot-dip galvanized steel sheet, will be described in detail.

In the present disclosure, the composition may be surface-treated on galvanized steel sheet, preferably on a ternary (Zn—Mg—Al-based) hot-dip galvanized steel sheet.

That is, the surface-treated steel sheet according to the present disclosure may include a steel sheet, a Zn—Mg—Al-based plating layer formed on at least one surface of the steel sheet, and a surface-treated coating layer formed on the plating layer.

Here, the steel sheet is a base steel sheet from which the plated steel sheet may be obtained, and in particular, any steel sheet that may obtain the ternary (Zn—Mg—Al-based) hot-dip galvanized steel sheet may be used.

The Zn—Mg—Al-based plating layer may include compositions, by wt %, magnesium (Mg): 4.0 to 7.0%, aluminum (Al): 11.0 to 19.5%, the balance Zn, and other inevitable impurities.

Magnesium (Mg) in the plating layer is an element that plays a role in improving the corrosion resistance of the plated steel sheet, and its content may be 4.0% or more to ensure the excellent corrosion resistance as desired in the present disclosure. However, when the Mg content is excessive, there is a risk of generating dross in a plating bath, and there is a risk of deteriorating bendability of the steel sheet by excessively forming high hardness intermetallic compounds in the plating layer. As a result, the Mg content may be limited to 7.0%.

Meanwhile, when the Mg content is added to 4.0% or more, there is a risk of dross generation due to Mg oxidation in a plating bath, so aluminum (Al) may be included in an amount of 11.0% or more by taking into considering the risk. However, when the Al content is excessive, a melting point of the plating bath increases and the resulting operating temperature becomes excessively high, which may cause problems due to a high-temperature work, such as erosion of the plating bath structure and denaturation of the steel sheet. Therefore, the Al content may be limited to 19.5% or less.

The composition of the balance excluding Mg and Al is zinc (Zn), and inevitable impurities may be unintentionally mixed in the process of manufacturing the plated steel sheet with the Zn—Mg—Al-based plating layer. In this case, it should be noted that those skilled in the art may easily understand the meaning of inevitable impurities.

The structure of the above-described Zn—Mg—Al-based plating layer satisfies the following [Relational Expression 1].

$$0.26 \le I(110)/I(103) \le 0.65 \qquad \text{[Relational Expression 1]}$$

(In the Relational Expression 1, I(110) represents an X-ray diffraction integrated intensity of a (110) plane crystal peak for a $MgZn_2$ phase, and I(103) represents an X-ray diffraction integrated intensity of the (103) plane crystal with respect to the $MgZn_2$ phase.)

In the present disclosure, the bendability, whiteness, etc., of the plated steel sheet may be secured by controlling the $MgZn_2$ phase of the Zn—Mg—Al-based plating layer using the above [Relational Expression 1].

When the value defined by the above [Relational Equation 1] is less than 0.26, a presence ratio of (103) plane crystal for the $MgZn_2$ phase is excessive compared with the (110) plane crystal for the $MgZn_2$ phase, so the bendability or whiteness may become insufficient. On the other hand, when the value exceeds 0.65, the presence ratio of the (110) plane crystal for the $MgZn_2$ phase compared with the (103) plane crystal for the $MgZn_2$ phase is too excessive, so the increase in diffuse reflection may not be induced and the whiteness may be insufficient.

In this case, the I(110) may have an integrated intensity value in the range of 120 to 200, and the I(103) may have an integrated intensity value in the range of 240 to 300. In this way, the value of [Relational Expression 1] may be satisfied within each range.

An upper portion of the above-described Zn—Mg—Al-based plating layer may be coated with the composition of the present disclosure in a solution state to include the coating layer. In this case, the coating layer may have a thickness of 0.3 to 1.5 μm.

When the thickness of the coating layer is less than 0.3 μm, the surface treatment solution composition may be applied thinly to a peak part of roughness on the surface of the plated steel sheet, causing the problem of reduced corrosion resistance, whereas when the thickness exceeds 1.5 μm, as the film layer is formed thickly, so processability deteriorates and solution processing costs increase, which is economically disadvantageous.

Here, the thickness refers to the thickness after drying.

Furthermore, the present disclosure describes a method for manufacturing a surface-treated steel sheet using the composition, specifically a surface-treated ternary hot-dip galvanized steel sheet.

More specifically, the method may include: forming a Zn—Mg—Al-based plating layer by hot-dip galvanizing at least one surface of a steel sheet; performing coating treatment by applying the composition of the present disclosure on a plating layer in a solution state; and drying the coated steel sheet.

When applying the composition of the present disclosure to the steel sheet in the solution state, a commonly used coating method may be applied, and therefore, there is no particular limitation.

For example, the coating process may be performed by selecting one of methods such as bar coating, roll coating, spraying, dipping, spray squeezing, and dipping squeezing.

When applying the composition by the above-described coating method, the composition may be applied at a thickness of 2.5 to 12.5 μm. By applying the composition within the above-described range, it is possible to secure the coating layer having the intended film thickness after drying, preferably 0.3 to 1.5 μm.

The process of drying the steel sheets coated with the composition may be performed in a temperature range of 40 to 200° C. based on peak metal temperature (PMT) of the material steel sheets (steel sheets).

Based on the PMT of the material steel sheet, if the temperature is less than 40° C., there is a risk that the corrosion resistance and anti-blackening properties may deteriorate due to insufficient formation of a solid film structure. On the other hand, when the temperature exceeds 200° C., the hardness of the film increases excessively, which reduces the corrosion resistance of the processed area, and the water vapor evaporated during the subsequent cooling process may cause a condensation phenomenon to condense on an upper portion of the drying equipment, reducing the surface quality of products.

Meanwhile, the drying may be performed in a hot air drying furnace or an induction heating furnace.

When performing the drying treatment using the hot air drying furnace, the internal temperature of the hot air drying furnace may be maintained at 100 to 300° C. In addition, when performing the drying treatment using the induction heating furnace, a current applied to the induction heating furnace may be 1000 to 5000 A, and more preferably 1500 to 3500 A.

When the internal temperature of the hot air drying furnace is less than 100° C. or the current applied to the induction heating furnace is less than 1000 A, the film bonding of the coated composition is not completely achieved, so the corrosion resistance and the anti-blackening properties may deteriorate. On the other hand, when the internal temperature of the hot air drying furnace exceeds 300° C. or the current applied to the induction heating furnace exceeds 5000 A, since the hardness of the film increases excessively, the corrosion resistance of the processed area decreases, work productivity deteriorates due to the generation of water vapor and fume during the subsequent cooling process, and the evaporated water vapor may cause a condensation phenomenon to condense on the upper portion of the drying equipment to deteriorate the surface quality of products.

When the dried film layer (coating layer) is formed by completing the drying treatment process as described above, the finally coated steel sheet may be obtained through an additional air-cooling or water-cooling cooling process.

In this case, there is no particular limitation on the conditions of the cooling process, and it should be noted that these process conditions are at the level generally applied.

In the present disclosure, the method of manufacturing a surface-treated ternary hot-dip galvanized steel sheet may be performed as a continuous process, and the speed of the continuous process may be limited to 50 to 120 mpm.

When the speed of the continuous process is less than 50 mpm, there is a problem of reduced productivity, whereas when the speed exceeds 120 mpm, there is a risk that the solution may scatter during the drying of the composition in the solution state applied to the surface of the steel sheet, causing the surface defects.

MODE FOR INVENTION

Hereinafter, the present disclosure will be described in more detail with reference to Examples. However, the description of these examples is only for illustrating the practice of the present disclosure, and the present disclosure is not limited by the description of these examples. This is because the scope of the present disclosure is determined by the matters described in the claims and the matters reasonably inferred therefrom.

EXAMPLE

[Manufacturing of Test Specimen]

A ternary (Zn—Mg—Al based) hot-dip galvanized plating layer was formed of, by wt %, Mn: 5.0%, Al: 12.0%, the balance Zn, and inevitable impurities, and ternary hot-dip galvanized steel sheets with a value of [Relational Expression 1] of 0.45 were cut into pieces measuring 7 cm (width)×15 cm (length) to remove oil.

Thereafter, a composition produced as follows was applied to surface of the hot-dip galvanized steel sheet with a bar coater and hardened under conditions of 60±20° C. based on peak metal temperature (PMT) to produce a test specimen.

[Test and Evaluation Method]

For the test specimen manufactured according to the above, corrosion resistance of flat plate, corrosion resistance of a processed area, anti-blackening properties, alkali resistance, foreign object staining property, and solution stability were evaluated through the following methods, and each result was shown in a table below.

<Corrosion Resistance of Flat Plate>

According to the method specified in ASTM B117, a generation rate of white rust of a steel sheet over time after a specimen was treated was measured. In this case, the evaluation criteria are as follows.

◎: The time taken until white rust occurs is 144 hours or more

○: The time taken until white rust occurs is 96 hours or more and less than 144 hours.

Δ: The time taken until white rust occurs is 55 hours or more and less than 96 hours.

X: The time until white rust occurs is less than 55 hours

<Corrosion Resistance of Processed Area>

After the specimen was pushed up to a height of 6 mm using an Erichsen tester, the degree of occurrence of white rust was measured when 24 hours has elapsed. In this case, the evaluation criteria are as follows.

◎: The occurrence area of white rust is less than 5% after 48 hours has elapsed

○: The occurrence area of white rust is 5% or more and less than 7% after 48 hours has elapsed Δ: The occurrence area of white rust is 7% or more and less than 10% after 48 hours has elapsed X: The occurrence area of white rust is 10% or more after 48 hours has elapsed <Anti-Blackening Properties>

By leaving a specimen in a thermo-hygrostat maintained at a temperature of 50° C. and relative humidity of 95% for 120 hours, a change in color (color difference: ΔE) of the specimen before and after the test was observed. In this case, the evaluation criteria are as follows.

◎: $\Delta E \leq 2$

○: $2 < \Delta E \leq 3$

△: $3 < \Delta E \leq 4$

×: $\Delta E > 4$

<Alkali Resistance>

After the specimen was dipped in an alkaline degreasing solution at 60° C. for 2 minutes, washed with water, and subjected to air blowing, the color difference (ΔE) before/after the dipping was measured. As the alkaline degreasing solution, Finecleaner L 4460 A: 20 g/2.4 L+L 4460 B 12 g/2.4 L (pH=12) manufactured by Daehan Parkerizing Co., Ltd., was used. In this case, the evaluation criteria are as follows.

◎: $\Delta E \leq 2$

○: $2 < \Delta E \leq 3$

△: $3 < \Delta E \leq 4$

×: $\Delta E > 4$

<Foreign Object Staining Property>

After rubbing the specimen with a load of 2.5 kg applied to a metal tip attached to white gauze, the change in whiteness (whiteness color difference: ΔL) of the white gauze before and after the test was observed. In this case, the evaluation criteria were as follows.

◎: $\Delta L \leq 1.0$

○: $1.0 < \Delta L \leq 2.0$

△: $2.0 < \Delta L \leq 2.5$

×: $\Delta L > 2.5$

<Solution Stability>

After each composition for surface treatment was put in a container and in a constant temperature oven at 50° C., and stored for 7 days, the occurrence of precipitates was visually observed, and the change in viscosity was measured. In this case, the evaluation criteria are as follows.

○: No precipitation, change in viscosity less than 1 CP

Δ: No precipitation, change in viscosity of 1 to 5 CP

X: Occurrence of precipitation or change in viscosity exceeding 5 CP

Experiment 1. Change in Physical Properties Depending on Content of Chromium Compound First, the composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 1 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, the alkali resistance, and the solution stability of each specimen which is applied with the solution composition prepared according to the contents in Table 1 below and dried were evaluated, and the results are shown in Table 1 below.

TABLE 1

| | Composition of Composition (100 wt % of solid part, wt %) | | | | | | |
|---|---|---|---|---|---|---|---|
| Division | Chromium Compound | Reducing Agent | Catalyst | Rust Prevention Coating Agent | Rust Prevention Etchant | Corrosion Resistance Additive | Lubricant |
| Comparative Example 1 | 10 | 3 | 1 | 75 | 3 | 5 | 2.5 |
| Inventive Example 1 | 15 | 3 | 1 | 70 | 3 | 5 | 2.5 |
| Inventive Example 2 | 30 | 3 | 1 | 55 | 3 | 5 | 2.5 |
| Inventive Example 3 | 45 | 2 | 0.5 | 45 | 2.5 | 3 | 1.5 |
| Comparative Example 2 | 50 | 1 | 0.5 | 45 | 1 | 1.5 | 0.5 |

| | | Physical Property Evaluation | | | | |
|---|---|---|---|---|---|---|
| Division | Composition of Composition (100 wt % of solid part, wt %) Defoamer | Corrosion Resistance of Flat Plate | Corrosion Resistance of Processed Area | Anti-blackening properties | Alkali Resistance | Solution stability |
| Comparative Example 1 | 0.5 | × | × | ○ | ○ | ○ |
| Inventive Example 1 | 0.5 | ○ | ◎ | ○ | ○ | ○ |
| Inventive Example 2 | 0.5 | ◎ | ◎ | ◎ | ◎ | ○ |
| Inventive Example 3 | 0.5 | ◎ | ◎ | ◎ | ◎ | ○ |
| Comparative Example 2 | 0.5 | × | × | × | ○ | ○ |

As shown in Table 1 above, when surface-treating the composition containing the chromium compound and other components according to the contents suggested in the present disclosure, all physical properties exhibited good or better results.

On the other hand, Comparative Example 1, which had an insufficient content of the chromium compound, exhibited poor corrosion resistance of a flat plate and corrosion resistance of a processed area, and Comparative Example 2, which had the excessive content of the chromium compound, also exhibited poor anti-blackening properties along with the corrosion resistance of the flat plate and the corrosion resistance of the processed area.

Experiment 2. Change in Physical Properties Depending on Content Ratio A/(A+B) of Chromium Compound A composition was produced by adding, based on 100 wt % of solid part, 28 wt % of chromium compound, 65 wt % of organosilane sol-gel binder (3-glycyloxypropyl methyldiethoxysilane and 3-aminopropyl triethoxy silane) as a rust prevention coating agent, 2.8 wt % of titanium hydrofluoric acid as a rust prevention etchant, 1 wt % of lithium silica sol as a corrosion resistance additive, 0.5 wt % of polyethylene wax as a lubricant, and 0.2 wt % of polydimethylsiloxane as a defoamer. In this case, by considering that the solvent (water, ethyl alcohol) is removed in the dry film state, the contents of each component were expressed based on 100% of solid part.

The chromium compound was produced by adding 2 wt % of phosphorous acid as a reducing agent and 0.5 wt % of phosphoric acid as a catalyst to the chromium solution in which the chromium nitrate A and the chromate B were dissolved in water. In this case, the content ratio A/(A+B) of the chromium nitrate A and the chromate B was controlled differently as shown in Table 2 below, and the reduction ratio was controlled to 0.85.

In producing the composition in the solution state, 61 wt % of water and 26 wt % of ethyl alcohol were added based on 13% of the solid part of the produced composition.

As shown in Table 2 below, the corrosion resistance of the flat plate, the corrosion resistance of the processed area, the anti-corrosion resistance and the solution stability of each specimen that is applied with the solution composition produced by differently applying the content ratios of the chromium nitrate A and the chromate B and dried were evaluated, and the results are shown in Table 2 below.

TABLE 2

| | Content Ratio of Chromium Compound | | | Physical Property Evaluation | | | |
|---|---|---|---|---|---|---|---|
| Division | Chromium Nitrate (A) | Chromate (B) | Content Ratio (A/(A + B)) | Corrosion Resistance of Flat Plate | Corrosion Resistance of Processed Area | Anti-blackening properties | Solution stability |
| Comparative Example 3 | 5.6 | 22.4 | 0.2 | × | × | × | ○ |
| Inventive Example 4 | 8.4 | 19.6 | 0.3 | ○ | ◎ | ○ | ○ |
| Inventive Example 5 | 11.2 | 16.8 | 0.4 | ◎ | ◎ | ◎ | ○ |
| Inventive Example 6 | 14 | 14 | 0.5 | ◎ | ◎ | ◎ | ○ |
| Inventive Example 7 | 16.8 | 11.2 | 0.6 | ◎ | ◎ | ◎ | ○ |
| Comparative Example 4 | 19.6 | 8.4 | 0.7 | ○ | ○ | ○ | × |

As shown in the above Table 2, when the content ratios of the chromium nitrate and the chromate satisfy the range suggested by the present disclosure (Inventive Examples 4 to 7), all the physical properties exhibited good or better results.

On the other hand, Comparative Example 3, where the content ratio was too small, exhibited poor corrosion resistance of a flat plate, corrosion resistance of a processed area, and anti-blackening properties, and Comparative Example 4, where the content ratio was excessive, exhibited poor solution stability.

Experiment 3. Change in Physical Properties Depending on Reduction Ratio of Chromium Compound The composition, in which only the reduction ratio of the chromium compound of the composition used in the above Experiment 2, that is, the reduction ratio (trivalent chromium ion/(trivalent chromium ion+hexavalent chromium ion)) of trivalent chromium ion and hexavalent chromium ion was controlled differently, was produced. In this case, the content ratio A/(A+B) of the chromium nitrate A and the chromate B was controlled to 0.5.

Thereafter, 61 wt % of water and 26 wt % of ethyl alcohol were added based on 13% of the solid part of the composition produced in the same manner as in Experiment 2 to obtain the solution composition.

The corrosion resistance of the flat plate, the corrosion resistance of the processed area, the anti-blackening properties, and the solution stability of each specimen which is applied with the solution composition produced by differently applying the reduction ratio in Table 3 below and dried were evaluated, and the results are shown in Table 3 below.

TABLE 3

| Division | Reduction Ratio of Chromium Compound Trivalent Chromium Ion/ (Trivalent Chromium Ion + Hexavalent Chromium Ion) | Physical Property Evaluation | | | |
|---|---|---|---|---|---|
| | | Corrosion Resistance of Flat Plate | Corrosion Resistance of Processed Area | Anti-blackening properties | Solution stability |
| Comparative Example 5 | 0.70 | X | X | X | ○ |
| Inventive Example 8 | 0.75 | ○ | ◎ | ○ | ○ |
| Inventive Example 9 | 0.80 | ◎ | ◎ | ◎ | ○ |
| Inventive Example 10 | 0.85 | ◎ | ◎ | ◎ | ○ |
| Inventive Example 11 | 0.90 | ◎ | ◎ | ◎ | ○ |
| Comparative Example 6 | 0.95 | ○ | X | ○ | X |

As shown in the above Table 3, when the reduction ratio of the chromium nitrate satisfies the range suggested by the present disclosure (Inventive Examples 8 to 11), all the physical properties exhibited good or better results.

On the other hand, Comparative Example 5, where the reduction ratio of the chromium compound was too small, exhibited poor corrosion resistance of a flat plate, corrosion resistance of a processed area, and anti-blackening properties, and Comparative Example 6, where the reduction ratio of the chromium compound was excessive, exhibited poor corrosion resistance of a processed area and solution stability.

Experiment 4. Change in Physical Properties Depending on Content of Reducing Agent The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 4 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the solution stability of each specimen which is applied with the solution composition produced according to the contents in Table 4 below and dried were evaluated, and the results are shown in Table 4 below.

TABLE 4

| Division | Composition of Composition (100 wt % of solid part, wt %) | | | | | |
|---|---|---|---|---|---|---|
| | Chromium Compound | Reducing Agent | Catalyst | Rust Prevention Coating Agent | Rust Prevention Etchant | Corrosion Resistance Additive |
| Comparative Example 7 | 35 | 0.3 | 1 | 56.2 | 2.5 | 3 |
| Inventive Example 12 | 35 | 0.5 | 0.5 | 55 | 2.5 | 4 |
| Inventive Example 13 | 35 | 1.5 | 1 | 55 | 2.5 | 3.5 |
| Inventive Example 14 | 35 | 3.5 | 1 | 55 | 2.0 | 2 |
| Inventive Example 15 | 35 | 5.0 | 1.5 | 54 | 1.5 | 1.5 |
| Comparative Example 8 | 35 | 5.5 | 1.5 | 53.5 | 1.5 | 1.5 |

| Division | Composition of Composition (100 wt % of solid part, wt %) | | Physical Property Evaluation | | | |
|---|---|---|---|---|---|---|
| | Lubricant | Defoamer | Corrosion Resistance of Flat Plate | Corrosion Resistance of Processed Area | Anti-blackening properties | Solution stability |
| Comparative Example 7 | 1.5 | 0.5 | × | × | × | ○ |
| Inventive Example 12 | 2 | 0.5 | ○ | ◎ | ○ | ○ |

TABLE 4-continued

| | | | | | | |
|---|---|---|---|---|---|---|
| Inventive Example 13 | 1 | 0.5 | ◎ | ◎ | ◎ | ○ |
| Inventive Example 14 | 1 | 0.5 | ◎ | ◎ | ◎ | ○ |
| Inventive Example 15 | 1 | 0.5 | ◎ | ◎ | ◎ | ○ |
| Comparative Example 8 | 1 | 0.5 | ○ | × | ○ | × |

As shown in Table 4, Inventive Examples 12 to 15, which are cases of performing the surface treatment with the composition that satisfied all of the contents proposed in the present disclosure, exhibited good or better results in all physical properties.

On the other hand, Comparative Example 7, where the content of the reducing agent was insufficient, exhibited poor corrosion resistance of a flat plate, corrosion resistance of a processed area, and anti-blackening properties, and Comparative Example 8, where the content of the reducing agent was excessive, exhibited poor corrosion resistance of a processed area and solution stability.

Experiment 5. Change in Physical Properties Depending on Content of Catalyst

The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 5 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the solution stability of each specimen which is applied with the solution composition produced according to the contents in Table 5 below and dried were evaluated, and the results are shown in Table 5 below.

TABLE 5

| | Composition of Composition (100 wt % of solid part, wt %) | | | | | |
|---|---|---|---|---|---|---|
| Division | Chromium Compound | Reducing Agent | Catalyst | Rust Prevention Coating Agent | Rust Prevention Etchant | Corrosion Resistance Additive |
| Comparative Example 9 | 35 | 3.5 | 0 | 55 | 1.5 | 3.5 |
| Inventive Example 16 | 35 | 3.5 | 0.1 | 55 | 1.5 | 3.4 |
| Inventive Example 17 | 35 | 3.5 | 1 | 55 | 1.5 | 2.5 |
| Inventive Example 18 | 35 | 3.5 | 1.5 | 55 | 1.5 | 2.0 |
| Inventive Example 19 | 35 | 3.5 | 2 | 55 | 1.5 | 1.5 |
| Comparative Example 10 | 35 | 3.5 | 2.5 | 54.5 | 1.5 | 1.5 |

| | Composition of Composition (100 wt % of solid part, wt %) | | Physical Property Evaluation | | | |
|---|---|---|---|---|---|---|
| Division | Lubricant | Defoamer | Corrosion Resistance of Flat Plate | Corrosion Resistance of Processed Area | Anti-blackening properties | Solution stability |
| Comparative Example 9 | 1 | 0.5 | × | × | × | ○ |
| Inventive Example 16 | 1 | 0.5 | ○ | ◎ | ○ | ○ |

TABLE 5-continued

| | | | | | | |
|---|---|---|---|---|---|---|
| Inventive Example 17 | 1 | 0.5 | ◎ | ◎ | ◎ | ○ |
| Inventive Example 18 | 1 | 0.5 | ◎ | ◎ | ◎ | ○ |
| Inventive Example 19 | 1 | 0.5 | ◎ | ◎ | ◎ | ○ |
| Comparative Example 10 | 1 | 0.5 | × | × | ○ | ○ |

As shown in Table 5, Inventive Examples 16 to 19, which are cases of performing the surface treatment with the composition that satisfied all of the contents proposed in the present disclosure, exhibited good or better results in all physical properties.

On the other hand, Comparative Example 9, in which the catalyst was not added, exhibited poor corrosion resistance of a flat plate, corrosion resistance of a processed area, and anti-blackening properties, and Comparative Example 10, in which the content of the catalyst was excessive, exhibited poor corrosion resistance of a flat plate and corrosion resistance of a processed area.

Experiment 6. Change in Physical Properties Depending on Content of Rust Prevention Coating Agent The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 6 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the foreign object staining property of each specimen which is applied with the solution composition produced according to the contents in Table 6 below and dried were evaluated, and the results are shown in Table 6 below.

TABLE 6

| | Composition of Composition (100 wt % of solid part, wt %) | | | | | |
|---|---|---|---|---|---|---|
| Division | Chromium Compound | Reducing Agent | Catalyst | Rust Prevention Coating Agent | Rust Prevention Etchant | Corrosion Resistance Additive |
| Comparative Example 11 | 45 | 3.5 | 1 | 43 | 2.5 | 3.5 |
| Inventive Example 20 | 45 | 3.5 | 1 | 45 | 1.5 | 2.5 |
| Inventive Example 21 | 35 | 3.5 | 1 | 55 | 1.5 | 2.5 |
| Inventive Example 22 | 25 | 3.5 | 1 | 65 | 1.5 | 2.5 |
| Inventive Example 23 | 15.5 | 3.5 | 1.5 | 75 | 1.5 | 1.5 |
| Comparative Example 12 | 15 | 2.0 | 1.5 | 77 | 1.5 | 1.5 |

| | | | Physical Property Evaluation | | | |
|---|---|---|---|---|---|---|
| | Composition of Composition (100 wt % of solid part, wt %) | | Corrosion Resistance of Flat | Corrosion Resistance of Processed | Anti-blackening | Foreign Object Staining |
| Division | Lubricant | Defoamer | Plate | Area | properties | property |
| Comparative Example 11 | 1 | 0.5 | × | × | ○ | × |

TABLE 6-continued

| | | | | | | |
|---|---|---|---|---|---|---|
| Inventive Example 20 | 1 | 0.5 | ○ | ◎ | ○ | ○ |
| Inventive Example 21 | 1 | 0.5 | ◎ | ◎ | ◎ | ◎ |
| Inventive Example 22 | 1 | 0.5 | ◎ | ◎ | ◎ | ◎ |
| Inventive Example 23 | 1 | 0.5 | ◎ | ◎ | ◎ | ◎ |
| Comparative Example 12 | 1 | 0.5 | ○ | ○ | × | ○ |

As shown in the above Table 6, Inventive Examples 20 to 23, which are cases of performing the surface treatment with the composition that satisfied all of the contents proposed in the present disclosure, exhibited good or better results in all physical properties.

On the other hand, Comparative Example 11, in which the content of the rust prevention coating agent was insufficient, exhibited poor corrosion resistance of a flat plate, corrosion resistance of a processed area, and foreign object staining property, and Comparative Example 12, in which the content of the rust prevention coating agent was excessive, exhibited poor anti-blackening properties.

Experiment 7. Change in Physical Properties Depending on Content of Rust Prevention Etchant The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 7 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the foreign object staining property of each specimen which is applied with the solution composition produced according to the contents in Table 7 below and dried were evaluated, and the results are shown in Table 7 below.

TABLE 7

| | Composition of Composition (100 wt % of solid part, wt %) | | | | | |
|---|---|---|---|---|---|---|
| Division | Chromium Compound | Reducing Agent | Catalyst | Rust Prevention Coating Agent | Rust Prevention Etchant | Corrosion Resistance Additive |
| Comparative Example 13 | 35 | 3.5 | 1.5 | 55 | 0 | 3.5 |
| Inventive Example 24 | 35 | 3.5 | 1.5 | 55 | 0.1 | 3.4 |
| Inventive Example 25 | 35 | 3.5 | 1.5 | 55 | 1 | 2.5 |
| Inventive Example 26 | 35 | 3.5 | 1.5 | 55 | 2 | 1.5 |
| Inventive Example 27 | 35 | 3.5 | 1.5 | 54 | 3 | 1.5 |
| Comparative Example 14 | 35 | 3.5 | 1.5 | 53.5 | 3.5 | 1.5 |

| | | | Physical Property Evaluation | | | |
|---|---|---|---|---|---|---|
| | Composition of Composition (100 wt % of solid part, wt %) | | Corrosion Resistance of Flat | Corrosion Resistance of Processed | Anti-blackening | Foreign Object Staining |
| Division | Lubricant | Defoamer | Plate | Area | properties | property |
| Comparative Example 13 | 1 | 0.5 | × | × | ○ | ○ |
| Inventive Example 24 | 1 | 0.5 | ○ | ◎ | ○ | ○ |

TABLE 7-continued

| | | | | | | |
|---|---|---|---|---|---|---|
| Inventive Example 25 | 1 | 0.5 | ◎ | ◎ | ◎ | ◎ |
| Inventive Example 26 | 1 | 0.5 | ◎ | ◎ | ◎ | ◎ |
| Inventive Example 27 | 1 | 0.5 | ◎ | ◎ | ◎ | ◎ |
| Comparative Example 14 | 1 | 0.5 | ○ | ○ | × | ○ |

As shown in the above Table 7, Inventive Examples 24 to 27, which are cases of performing the surface treatment with the composition that satisfied all of the contents proposed in the present disclosure, exhibited good or better results in all physical properties.

On the other hand, Comparative Example 13, in which the content of the rust prevention etchant was insufficient, exhibited poor corrosion resistance of a flat plate and corrosion resistance of a processed area, and Comparative Example 14, in which the content of the rust prevention etchant was excessive, exhibited poor anti-blackening properties.

Experiment 8. Change in Physical Properties Depending on Content of Corrosion Resistance Additive The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 8 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the solution stability of each specimen which is applied with the solution composition produced according to the contents in Table 8 below and dried were evaluated, and the results are shown in Table 8 below.

TABLE 8

| | Composition of Composition (100 wt % of solid part, wt %) | | | | | |
|---|---|---|---|---|---|---|
| Division | Chromium Compound | Reducing Agent | Catalyst | Rust Prevention Coating Agent | Rust Prevention Etchant | Corrosion Resistance Additive |
| Comparative Example 15 | 35 | 3.5 | 1.5 | 56 | 2.5 | 0 |
| Inventive Example 28 | 35 | 3.5 | 1.5 | 56 | 2.4 | 0.1 |
| Inventive Example 29 | 35 | 3.5 | 1.5 | 56 | 1.5 | 1 |
| Inventive Example 30 | 35 | 3.5 | 1.5 | 55 | 1.5 | 2 |
| Inventive Example 31 | 32 | 3.5 | 1.5 | 55 | 1.5 | 5 |
| Comparative Example 16 | 32 | 3.5 | 1.5 | 54.5 | 1.5 | 5.5 |

| | Composition of Composition (100 wt % of solid part, wt %) | | Physical Property Evaluation | | | |
|---|---|---|---|---|---|---|
| Division | Lubricant | Defoamer | Corrosion Resistance of Flat Plate | Corrosion Resistance of Processed Area | Anti-blackening properties | Solution stability |
| Comparative Example 15 | 1 | 0.5 | ○ | × | ○ | ○ |
| Inventive Example 28 | 1 | 0.5 | ○ | ◎ | ○ | ○ |

TABLE 8-continued

| | | | | | | |
|---|---|---|---|---|---|---|
| Inventive Example 29 | 1 | 0.5 | ◎ | ◎ | ◎ | ○ |
| Inventive Example 30 | 1 | 0.5 | ◎ | ◎ | ◎ | ○ |
| Inventive Example 31 | 1 | 0.5 | ◎ | ◎ | ◎ | ○ |
| Comparative Example 16 | 1 | 0.5 | ○ | ○ | ○ | × |

As shown in the above Table 8, Inventive Examples 28 to 31, which are cases of performing the surface treatment with the composition that satisfied all of the contents proposed in the present disclosure, exhibited good or better results in all physical properties.

On the other hand, Comparative Example 15, in which the content of the corrosion resistance additive was insufficient, exhibited poor corrosion resistance of a processed area, and Comparative Example 16, in which the content of the corrosion resistance additive was excessive, exhibited poor solution stability.

Example 9: Change in Physical Properties Depending on Content of Lubricant

The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 9 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the foreign object staining property of each specimen which is applied with the solution composition produced according to the contents in Table 9 below and dried were evaluated, and the results are shown in Table 9 below.

TABLE 9

| | Composition of Composition (100 wt % of solid part, wt %) | | | | | |
|---|---|---|---|---|---|---|
| Division | Chromium Compound | Reducing Agent | Catalyst | Rust Prevention Coating Agent | Rust Prevention Etchant | Corrosion Resistance Additive |
| Comparative Example 17 | 33 | 3.5 | 1.5 | 57 | 3.0 | 1.5 |
| Inventive Example 32 | 33 | 3.5 | 1.5 | 57 | 2.9 | 1.5 |
| Inventive Example 33 | 33 | 3.5 | 1.5 | 57 | 2.0 | 1.5 |
| Inventive Example 34 | 33 | 3.5 | 1.5 | 56 | 2.0 | 1.5 |
| Inventive Example 35 | 33 | 3.5 | 1.5 | 55 | 2.0 | 1.5 |
| Comparative Example 18 | 33 | 3.5 | 1.5 | 54.5 | 2.0 | 1.5 |

| | Composition of Composition (100 wt % of solid part, wt %) | | Physical Property Evaluation | | | |
|---|---|---|---|---|---|---|
| Division | Lubricant | Defoamer | Corrosion Resistance of Flat Plate | Corrosion Resistance of Processed Area | Anti-blackening properties | Foreign Object Staining property |
| Comparative Example 17 | 0 | 0.5 | ○ | ○ | ○ | × |
| Inventive Example 32 | 0.1 | 0.5 | ○ | ◎ | ○ | ○ |
| Inventive Example 33 | 1 | 0.5 | ◎ | ◎ | ◎ | ◎ |

TABLE 9-continued

| | | | | | | |
|---|---|---|---|---|---|---|
| Inventive Example 34 | 2 | 0.5 | ◎ | ◎ | ◎ | ◎ |
| Inventive Example 35 | 3 | 0.5 | ◎ | ◎ | ◎ | ◎ |
| Comparative Example 18 | 3.5 | 0.5 | × | × | ○ | ○ |

As shown in Table 9, Inventive Examples 32 to 35, which are cases of performing the surface treatment with the composition that satisfied all of the contents proposed in the present disclosure, exhibited good or better results in all physical properties.

On the other hand, Comparative Example 17, which had insufficient lubricant content, exhibited poor staining property to foreign objects, and Comparative Example 18, which had an excessive content of lubricant, exhibited poor corrosion resistance of a flat plate and corrosion resistance of a processed area.

Example 10: Change in Physical Properties According to Defoamer

The composition for surface treatment was produced as follows.

A chromium compound was produced by adding phosphorous acid as a reducing agent and phosphoric acid as a catalyst to a chromium solution in which the chromium nitrate A and the chromate B were dissolved in water. In this case, a content ratio A/(A+B) of the chromium nitrate A and the chromate B was controlled to 0.5, and the reduction ratio was controlled to 0.85.

The composition was produced by adding an organosilane sol-gel binder (3-glycyloxypropyl methyldiethoxysilane and 3-aminopropyl triethoxy silane) as a rust prevention coating agent, titanium hydrofluoric acid as a rust prevention etchant, lithium silica sol as a corrosion resistance additive, polyethylene wax as a lubricant, and polydimethylsiloxane as a defoamer to the chromium compound. The contents of each component are shown in Table 10 below. Considering that the solvent (water, ethyl alcohol) is removed in the dry film state, the contents of each component were described based on 100% of solid part.

In producing the composition in the solution state, 61 wt % of water and 26 wt % of ethyl alcohol were added based on 13% of the solid part of the produced composition.

The corrosion resistance of the flat plate, the corrosion resistance of the processed area, the anti-blackening properties, and the solution stability of each specimen which is applied with the solution composition produced according to the contents in Table 10 below and dried were evaluated, and the results are shown in Table 10 below.

TABLE 10

| | Composition of Composition (100 wt % of solid part, wt %) | | | | | |
|---|---|---|---|---|---|---|
| Division | Chromium Compound | Reducing Agent | Catalyst | Rust Prevention Coating Agent | Rust Prevention Etchant | Corrosion Resistance Additive |
| Comparative Example 19 | 35 | 3.5 | 1.5 | 55.5 | 2.0 | 1.5 |
| Inventive Example 36 | 35 | 3.5 | 1.5 | 55.5 | 1.9 | 1.5 |
| Inventive Example 37 | 35 | 3.5 | 1.5 | 55.5 | 1.5 | 1.5 |
| Inventive Example 38 | 35 | 3.5 | 1.5 | 55 | 1.5 | 1.5 |
| Comparative Example 20 | 35 | 3.5 | 1.5 | 54.5 | 1.5 | 1.5 |

| | Composition of Composition (100 wt % of solid part, wt %) | | Physical Property Evaluation | | | |
|---|---|---|---|---|---|---|
| Division | Lubricant | Defoamer | Corrosion Resistance of Flat Plate | Corrosion Resistance of Processed Area | Anti-blackening properties | Solution stability |
| Comparative Example 19 | 1 | 0 | × | × | × | ○ |
| Inventive Example 36 | 1 | 0.1 | ○ | ◎ | ○ | ○ |
| Inventive Example 37 | 1 | 0.5 | ◎ | ◎ | ◎ | ○ |
| Inventive Example 38 | 1 | 1 | ◎ | ◎ | ◎ | ○ |
| Comparative Example 20 | 1 | 1.5 | ○ | ○ | ○ | × |

As shown in the above Table 10, Inventive Examples 36 to 38, which are cases of performing the surface treatment with the composition that satisfied all of the contents proposed in the present disclosure, exhibited good or better results in all physical properties.

On the other hand, Comparative Example 19, in which the content of the defoamer was insufficient, exhibited poor corrosion resistance of a flat plate, corrosion resistance of a processed area, and anti-blackening properties, and Comparative Example 20, in which the content of the defoamer was excessive, exhibited poor solution stability.

Experiment 11. Change in Physical Properties Depending on Thickness of Coating Layer and Drying Temperature The composition for surface treatment was produced as follows.

A composition was produced by adding, based on 100 wt % of solid part, 28 wt % of chromium compound, 65 wt % of organosilane sol-gel binder (3-glycyloxypropyl methyldiethoxysilane and 3-aminopropyl triethoxy silane) as a rust prevention coating agent, 2.8 wt % of titanium hydrofluoric acid as a rust prevention etchant, 1 wt % of lithium silica sol as a corrosion resistance additive, 0.5 wt % of polyethylene wax as a lubricant, and 0.2 wt % of polydimethylsiloxane as a defoamer.

Among the compositions, the chromium compound was produced by adding 2 wt % of phosphorous acid as a reducing agent and 0.5 wt % of phosphoric acid as a catalyst of to a chromium solution in which the chromium nitrate A and the chromate B are dissolved in water, and the content ratio A/(A+B) of the chromium nitrate A and the chromate B was controlled to 0.5, and the reduction ratio was controlled to 0.85.

In producing the composition in the solution state, 61 wt % of water and 26 wt % of ethyl alcohol were added based on 13% of the solid part of the produced composition.

The composition produced as described above was bar-coated in a solution state on a specimen (ternary hot-dip galvanized steel sheets having a size of 7 cm (width)×15 cm (length)) from which oil was removed, and then dried in hot air drying furnace (internal temperature of 250° C.) In this case, the thickness (dry thickness) of the coating layer and the drying temperature based on the PMT were controlled differently, and the corrosion resistance of the flat plate, the corrosion resistance of the processed area, the anti-blackening properties, and the alkali resistance of each specimen were evaluated, and the results are shown in the Table 11 below.

TABLE 11

| Division | Thickness of Coating Layer (μm) | Drying Temperature (° C.) | Corrosion Resistance of Flat Plate | Corrosion Resistance of Processed Area | Anti-blackening properties | Alkali resistance |
|---|---|---|---|---|---|---|
| Comparative Example 21 | 0.2 | 60 | × | × | Δ | Δ |
| Inventive Example 39 | 0.3 | 60 | ◎ | ◎ | ◎ | ◎ |
| Inventive Example 40 | 0.8 | 60 | ◎ | ◎ | ◎ | ◎ |
| Inventive Example 41 | 1.2 | 60 | ◎ | ◎ | ○ | ◎ |
| Inventive Example 42 | 1.5 | 60 | ◎ | ◎ | ○ | ◎ |
| Comparative Example 22 | 2.0 | 60 | ◎ | × | ○ | ◎ |
| Comparative Example 23 | 0.8 | 30 | × | × | × | × |
| Inventive Example 43 | 0.8 | 40 | ○ | ○ | ○ | Δ |
| Inventive Example 44 | 0.8 | 100 | ◎ | ◎ | ◎ | ◎ |
| Inventive Example 45 | 0.8 | 200 | ◎ | ◎ | ○ | ◎ |
| Comparative Example 24 | 0.8 | 220 | ◎ | ◎ | × | ◎ |

As shown in Table 11, Inventive Examples 39 to 42, in which the coating layer was formed to a thickness of 0.3 to 1.5 μm and dried at 60° C. based on PMT, exhibited good or better results in all physical properties. In addition, Inventive Examples 43 to 45, in which the coating layer was formed to a thickness of 0.8 μm and dried at 40 to 200° C. based on the PMT, exhibited good or better results.

On the other hand, in the case of Comparative Example 21, in which the thickness of the coating layer was thin at 0.2

μm, the anti-blackening properties and the alkali resistance were not excellent, and the corrosion resistance of the flat plate and the corrosion resistance of the processed area were very poor. Comparative Example 22, in which the coating layer was formed excessively thick, exhibited poor corrosion resistance of a processed area.

On the other hand, Comparative Example 23, in which the drying temperature was less than 40° C. based on the PMT, exhibited poor results in all physical properties as the composition was not sufficiently dried. Comparative Example 24, in which the drying temperature exceeded 200° C. based on the PMT, exhibited poor anti-blackening properties. This is due to the condensation occurring on the upper portion of the drying equipment due to the water vapor generated from the specimen during final cooling after completing the drying process, and due to the fume falling on the surface of the specimen.

The invention claimed is:

1. A composition for surface-treating a ternary hot-dip galvanized steel sheet, comprising:

with respect to 100 wt % of solid part of a composition, (a) 15 to 45 wt % of chromium compound;

(b) 45 to 75 wt % of rust prevention coating agent;

(c) 0.1 to 3.0 wt % of rust prevention etchant;

(d) 0.1 to 5.0 wt % of corrosion resistance additive;

(e) 0.1 to 3.0 wt % of lubricant; and (f) 0.1 to 1.0 wt % of defoamer, wherein the chromium compound is obtained by adding (g) 0.5 to 5.0 wt % of phosphorous acid as a reducing agent and (h) 0.1 to 2.0 wt % of phosphoric acid as a catalyst in a solution of chromium nitrate A and chromate B.

2. The composition of claim 1, wherein a content ratio (A/A+B) of the chromium nitrate and chromate is 0.3 to 0.6.

3. The composition of claim 1, wherein a reduction ratio of the chromium compound (trivalent chromium ion/(trivalent chromium ion+hexavalent chromium ion)) is 0.75 to 0.90.

4. The composition of claim 1, wherein the rust prevention coating agent is an organosilane sol-gel binder.

5. The composition of claim 1, wherein the rust prevention etchant is at least one selected from the group consisting of titanium hydrofluoric acid, silicified hydrofluoric acid, and zirconium hydrofluoric acid.

6. The composition of claim 1, wherein the corrosion resistance additive is at least one selected from the group consisting of lithium silica sol, sodium silicate, potassium silicate, lithium-potassium silicate, and lithium-sodium silicate.

7. The composition of claim 1, wherein the lubricant is at least one selected from the group consisting of polyethylene wax, polypropylene wax, carnauba wax, paraffin wax, polyamide wax, PTFE wax, eco-friendly oil wax, EAA wax, and synthetic EVA wax.

8. The composition of claim 1, wherein the composition further includes (i) a solvent, and a content of the solid part is 5 to 20 wt %, and the balance is a solvent.

9. The composition of claim 8, wherein the composition further includes an auxiliary solvent, and the auxiliary solvent includes 20 to 40 wt % of the total solvent of one or more selected from the group consisting of ethyl alcohol, methyl alcohol, isopropyl alcohol, 1-methoxy-2-propanol, and 2-butoxyethanol.

10. A surface-treated ternary hot-dip galvanized steel sheet, comprising:

a steel sheet;

a Zn—Mg—Al-based plating layer formed on at least one surface of the steel sheet; and a surface-treated coating layer formed on the plating layer, wherein the surface-treated coating layer is a coating layer formed of the composition of claim 1.

11. The surface-treated ternary hot-dip galvanized steel sheet of claim 10, wherein the Zn—Mg—Al-based plating layer includes 4.0 to 7.0 wt % of magnesium (Mg), 11.0 to 19.5 wt % of aluminum (Al), the balance Zn, and other inevitable impurities, and the following Relational Expression 1 is satisfied, $$0.26 \leq I(110)/I(103) \leq 0.65 \quad \text{[Relational Expression 1]}$$

(In the Relational Expression 1, I (110) represents an X-ray diffraction integrated intensity of a (110) plane crystal peak for a $MgZn_2$ phase, and I (103) represents an X-ray diffraction integrated intensity of the (103) plane crystal with respect to the $MgZn_2$ phase.

12. The surface-treated ternary hot-dip galvanized steel sheet of claim 10, wherein the surface-treated coating layer has a thickness of 0.3 to 1.5 μm.

13. A method for manufacturing a surface-treated ternary hot-dip galvanized steel sheet, comprising:

forming a Zn—Mg—Al-based plating layer by hot-dip galvanizing at least one surface of the steel sheet;

performing coating treatment on the composition of claim 1 on the plating layer; and performing drying treatment on the coated steel sheet.

14. The method of claim 13, wherein the composition is coated at a thickness of 2.5 to 12.5 μm.

15. The method of claim 13, wherein the coating treatment is performed by any one method selected from the group consisting of bar coating, roll coating, spraying, dipping, spray squeezing, and dip squeezing.

16. The method of claim 13, wherein the drying is performed in a temperature range of 40 to 200° C. based on peak metal temperature (PMT) of the steel sheet.

17. The method of claim 13, wherein the drying is performed in a hot air drying furnace or an induction heating furnace.

18. The method of claim 17, wherein the hot air drying furnace has an internal temperature of 100 to 300° C.

19. The method of claim 17, wherein the induction heating furnace is applied with a current of 1,000 to 5,000 A.

20. The method of claim 13, wherein the manufacturing method is performed in a continuous process, and a speed of the continuous process is 50 to 120 mpm.

* * * * *